United States Patent [19]

Bargholtz et al.

[11] Patent Number: 4,700,529

[45] Date of Patent: Oct. 20, 1987

[54] ROLL BANDING MACHINE AND METHOD

[75] Inventors: William E. Bargholtz; Robert E. Molison, both of Hanover, Pa.

[73] Assignee: Elsner Engineering Works, Inc., Hanover, Pa.

[21] Appl. No.: 17,086

[22] Filed: Feb. 20, 1987

[51] Int. Cl.[4] ..... B65B 11/04; B65B 13/16

[52] U.S. Cl. ..... 53/399; 53/465; 53/466; 53/216; 53/228; 53/586

[58] Field of Search ..... 53/399, 465, 466, 211, 53/216, 586, 228

[56] References Cited

U.S. PATENT DOCUMENTS

| | | | |
|---|---|---|---|
| 1,882,695 | 10/1932 | Aldrich et al. . | |
| 2,894,363 | 7/1959 | Voogd | 53/228 |
| 2,917,884 | 12/1959 | Winkler | 53/586 |
| 2,975,571 | 3/1961 | Aronson et al. | 53/198 |
| 3,382,648 | 5/1968 | Korzinek | 53/228 |
| 3,385,026 | 5/1968 | Schmermund | 53/228 |
| 3,621,633 | 11/1971 | Law | 53/586 |
| 3,659,394 | 5/1972 | Hartleib | 53/216 X |
| 3,683,585 | 8/1972 | Leszczynski | 53/51 |
| 3,990,215 | 11/1976 | Elsner et al. | 53/182 |
| 4,075,815 | 2/1978 | Carver | 53/32 |
| 4,423,584 | 1/1984 | Elsner et al. | 53/415 |
| 4,624,096 | 11/1986 | Nordstrom | 53/228 X |

FOREIGN PATENT DOCUMENTS 2410587 11/1979 Fed. Rep. of Germany .

*Primary Examiner*—John Sipos

*Attorney, Agent, or Firm*—Thomas Hooker

[57] ABSTRACT

The disclosure describes a machine for wrapping a band of self adhering transparent stretch plastic film around a roll of wound sheet material.

16 Claims, 17 Drawing Figures

ROLL BANDING MACHINE AND METHOD

The invention relates to apparatus and methods for wrapping bands of self-adhering thin transparent film around rolls, typically rolls of tightly wound sheet material such as wrapping paper and the like.

BACKGROUND OF THE INVENTION

Conventional roll overwrapping machines surround a roll of wound sheet material in a loose heat shrink plastic envelope which is subsequently passed through an oven and shrunk tightly on the roll. This type of machine is shown in U.S. Pat. No. 3,990,215, assigned to the assignee of the present invention. Overwrapping requires heat seal equipment and an oven and uses considerable wrapping material to surround the roll. Two heat seal seams extend along the wrapping. The wrapping does not adhere to the roll and is removable without injuring the roll.

It is also old to close rolls using a band of expensive heat shrink film or tape which is applied and holds the paper on the roll from unwinding. Also the tape adheres to the wound paper and frequently injures the paper when removed.

SUMMARY OF THE INVENTION

The disclosed banding machine wraps one or more thin, transparent bands of self-adhering plastic stretch film around rolls to hold the wound paper in place on the roll. The bands are wrapped around the roll as the roll is rotated through the machine. Rotation of the roll during wrapping of the roll tightens the band so that overlying layers of the film adhere to each other to hold the paper in place. The film bands are easily removed without injury to the paper on the roll. The bands are transparent and permit unobstructed view of the paper on the roll.

The described machine includes one or more band wrapping stations or assemblies spaced across the path of roll movement through the machine. A film feed unit located on one side of the path of movement extends across the path, engages the lead end of a film strip and pulls the strip across the path and onto a retention unit which holds the film in place. The gripper then releases the end of the film and a cutter on the other side of the path severs the film from the film source. Rolls are rotated down the path, into the film extending across the path and wind the film around the roll to form the band. The end of the film held against the retention unit is wound onto roll. The other end is held and then tucked into the nip between the roll and the film pulled from the unit. During continued winding the film tightens against the roll and adheres against itself.

If desired, the machine may be located adjacent a roll winding machine so that rolls with wound lengths of paper are discharged from the roll winding machine directly into the banding machine and are banded to hold the paper on the roll.

Other objects and features of the invention will become apparent as the description proceeds, especially when taken in conjunction with the accompanying drawings illustrating the invention, of which there are six sheets and one embodiment.

DETAILED DESCRIPTION OF THE PREFERRED EMBODIMENTS OF THE INVENTION

Figures 1, 2:
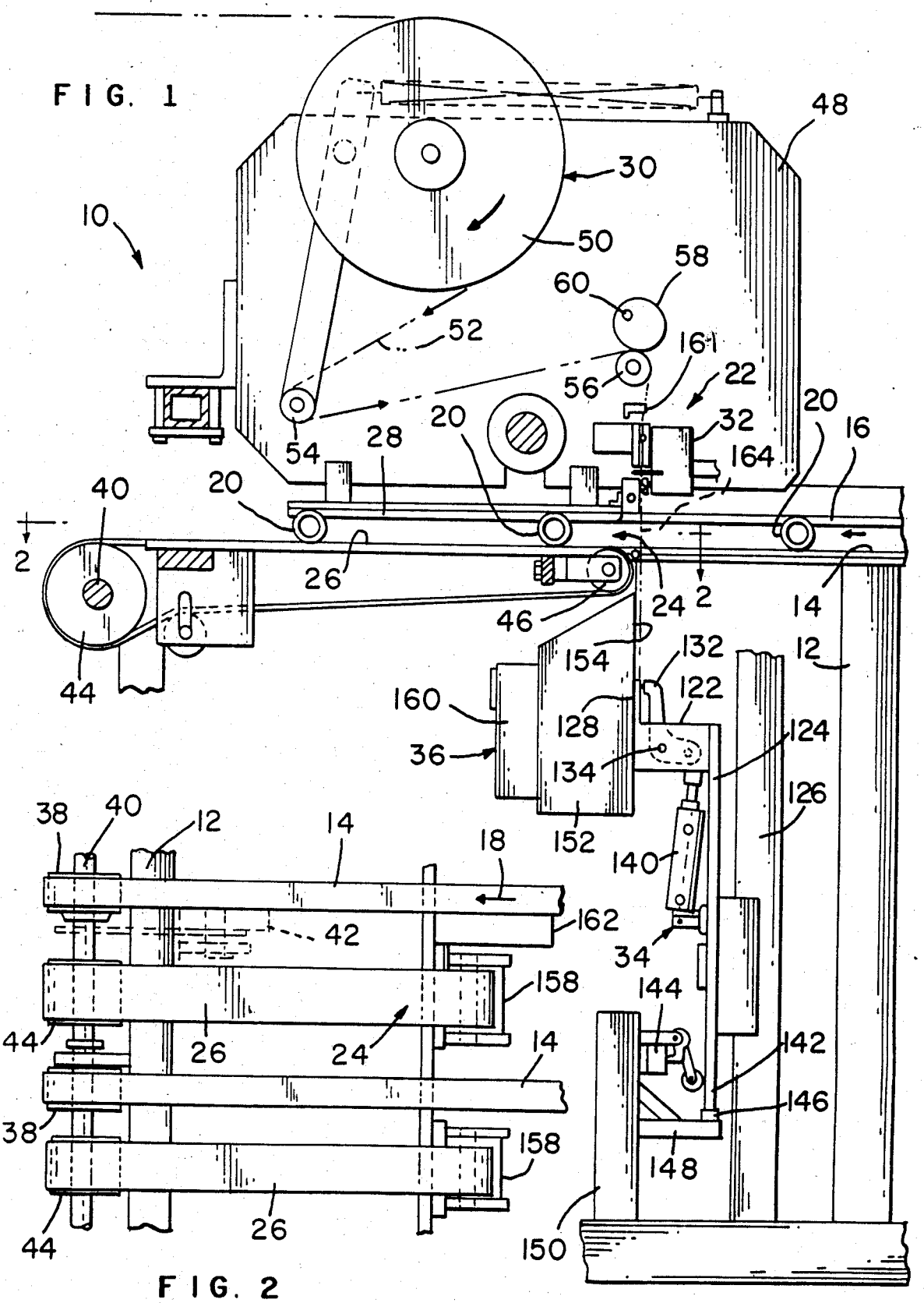
FIG. 1 is a sectional view taken through the roll banding machine adjacent a banding assembly.
FIG. 2 is a plan view, partially broken away, taken along line 2—2 of FIG. 1.

Roll banding machine 10 includes a frame 12 supporting a number of long roll infeed conveyor belts 14 and resilient hold down strips 16 located above the belts as shown in FIG. 1. Pairs of belts and hold down strips are spaced across the machine as indicated in FIG. 2. Belts 14 are moved in the downstream direction indicated by arrow 18 in FIG. 2 so that a supply of rolls 20 captured between the belts and hold down strips at the upstream end of the machine are rotated downstream through the machine against the strips by the belts. Rolls 20 preferably include a cardboard core and a length of paper tightly wound on the core. The end of the paper is free and is held against the roll during movement through the machine by the strips and belts. Rolls 20 may be provided to machine 10 by an automatic roll winding machine located at the upstream end of belts 14 and adjusted to deliver spaced rolls 20 on belts 14 as illustrated in FIG. 1.

Machine 10 bands rolls as received at a banding zone. Rolls may be banded at production rates of up to 40 rolls per minute.

The machine 10 includes one or more roll banding assemblies 22 located at locations spaced across the path of movement of rolls 20 through the machine for wrapping short segments of transparent self adhering film around the roll to hold the paper on the roll after discharge from the machine. Each assembly wraps the film on a roll as the roll moves through a wrapping zone 24. The assemblies each include a roll on conveyor belt 26 and associated hold down strip 28 extending downstream from the wrapping zone 24, a self-adhering stretch film supply 30 and film clamp and cut off unit 32 both located above the wrapping zone and film feed or pull down unit 34 and film retention unit 36 both located beneath the wrapping zone.

Belts 14 extend around rollers 38 located downstream on the machine and similar rollers (not illustrated) on the upstream end of the machine. Rollers 38 are mounted on a shaft 40 rotated by suitable drive 42 to move the upper runs of the belts in the downstream direction of arrow 18. Roll on conveyor belts 26 extend around rollers 44 on shaft 40 and upstream rollers 46. Each belt 26 is located beneath a wrapping zone 24. The rollers 44 are the same diameter as rollers 38 so that drive 42 moves the upstream runs of belts 14 and 26 downstream at the same rate and rolls 20 are continuously rotated downstream against strips 16 and 28 from the upstream to the downstream end of the machine; from right to left as shown in FIG. 1.

A vertical support plate 48 is mounted on frame 12 above each wrapping zone 24. Film supply 30, which may be a roll of thin, transparent and adhering plastic film 52 is mounted on the plate. The film is led around tensioning roller 54 and one way clutch roller 56 to the clamp and cutoff unit 32. Hold down 58 is pivotedly mounted on pin 60 and retains the film against roller 56 to prevent withdrawal of the film and maintain tension.

Figure 8:
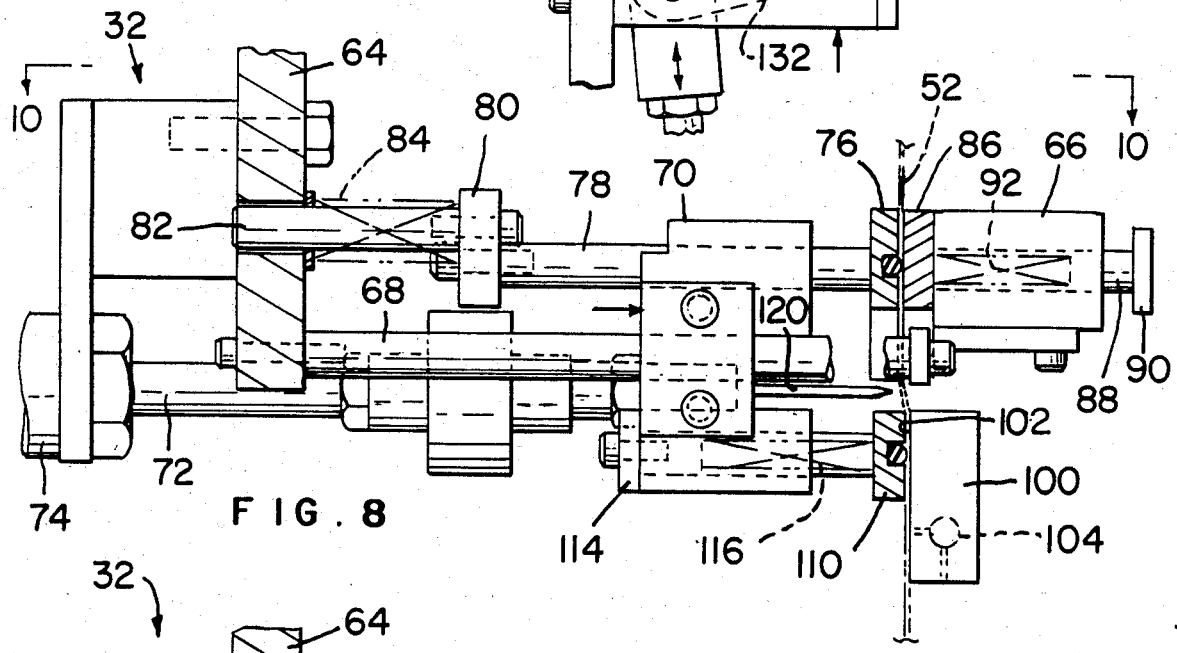
Figure 9:
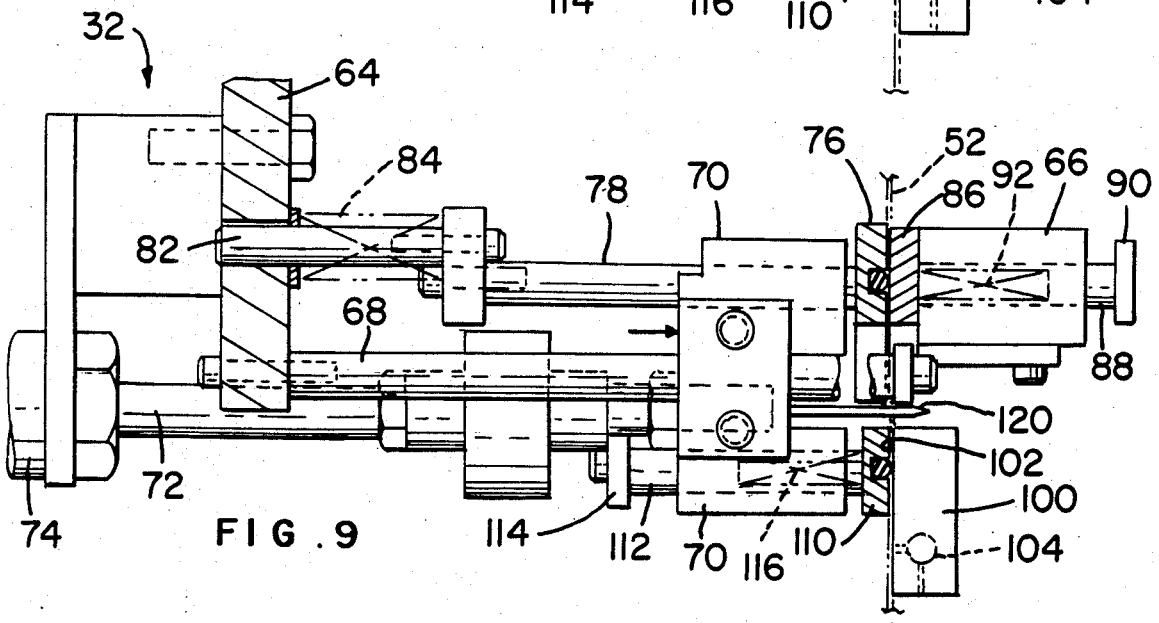
Figure 10:
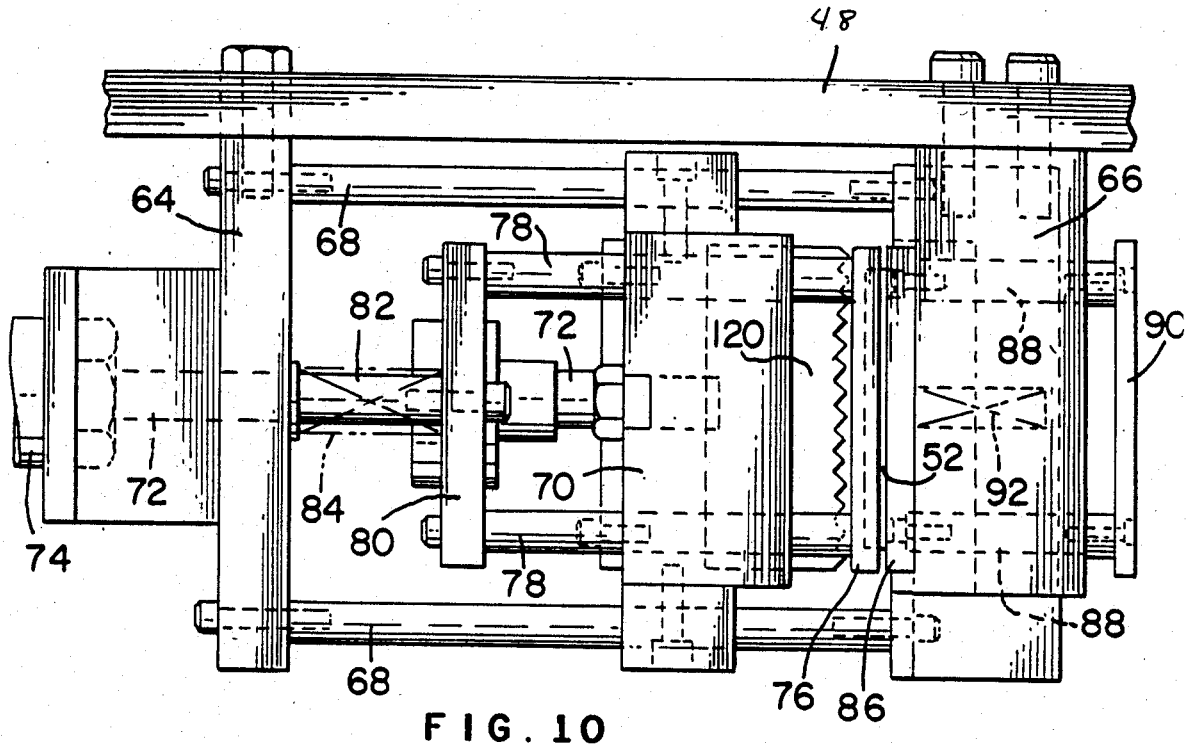
FIG. 10 is a top view taken along line 10—10 of FIG. 8.

The film clamp and cut off unit 32 is illustrated in FIGS. 7 through 10. The unit is secured to members 64 and 66 on plate 48 as shown in FIG. 10. Support bracket 64 is mounted on the frame 48 on the upstream side of film 52 and clamp mounting block 66 is mounted to the frame 48 on the downstream side of the film 52. A pair of spaced cylinder support rods 68 extend between bracket 64 and block 66 and support cut-off housing 70 for movement toward and away from the film. The piston rod 72 of cylinder 74 mounted on bracket 64 is connected to housing 70 so that extension and retraction of the cylinder moves the housing along rods 68 toward and away from the film.

Film clamp plate 76 adjacent film 52 is mounted on the ends of a pair of spaced shafts 78 extending through housing 70. A back plate 80 is mounted on the ends of shafts 78 away from the film. Plate 80 carries a shaft 82 extending into a bore in bracket 64. Spring 84 is confined on shaft 82 between plate 80 and bracket 64 to bias the film clamp plate 76 toward film 52.

Figure 7:
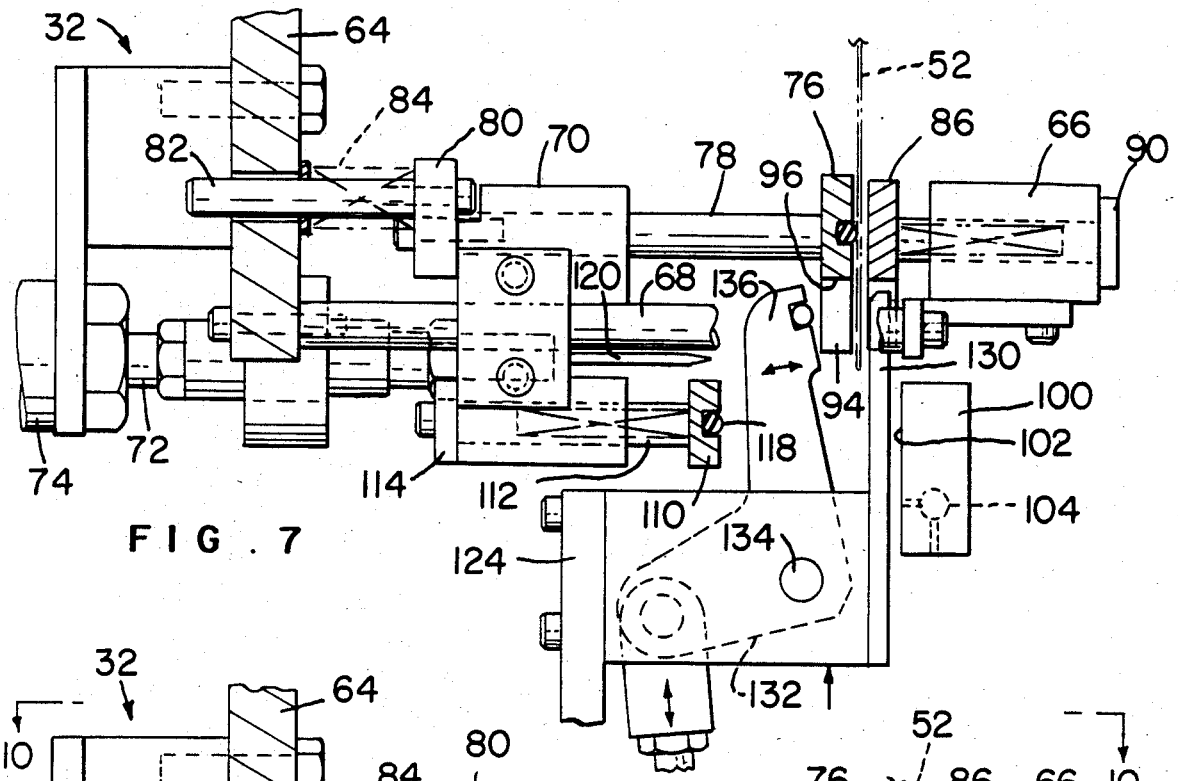
FIGS. 7, 8 and 9 are further enlarged sectional views illustrating clamping, pick-up and severing of the film above the roll path.
Figure 11:
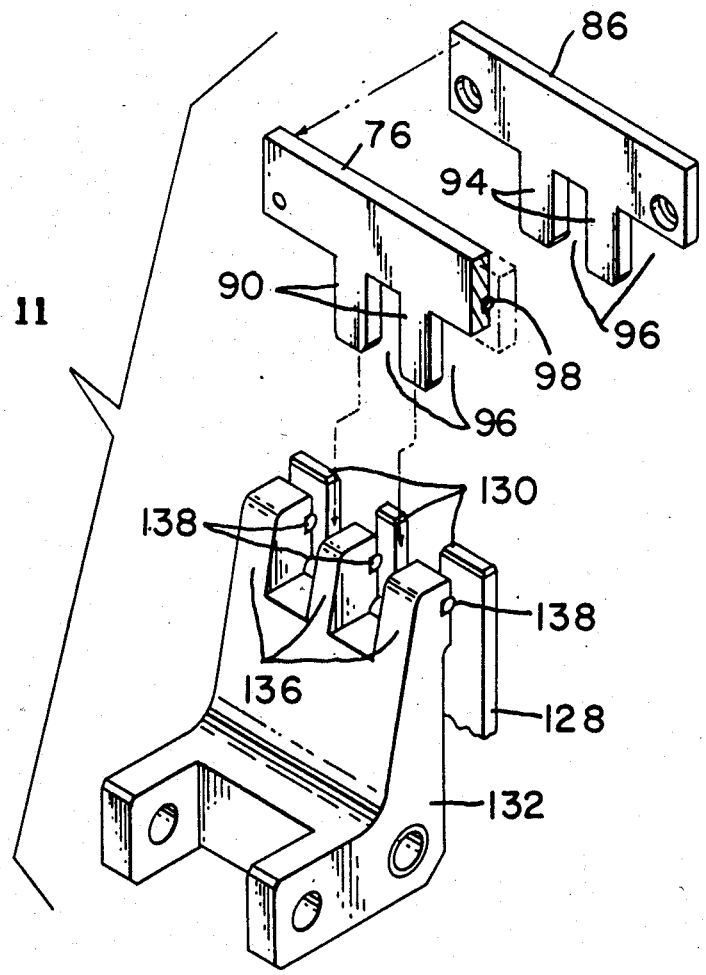
FIG. 11 is an exploded view illustrating the film clamp.

Film clamp back-up plate 86 is located on the opposite side of film 52 across from film clamp 76 and is mounted on the ends of a pair of shafts 88 extending through the clamp mounting block 66. A retaining plate 90 is mounted on the ends of the shafts on the opposite side of the block. Plate 90 limits the movement of plate 86 away from block 66. Spring 92 is confined in a recess in block 66 and biases plate 86 away from block 66. Plate 90 limits movement of the plate 86 as shown in FIG. 7. Plates 76 and 86 each include spaced gripping teeth 94 extending downwardly toward film feed unit 34. See FIG. 11. The teeth on each plate overlie each other to define aligned recesses 96 on either side of the film. A resilient film-clamping bead 98 is confined in the clamping face of plate 76.

A fixed back-up block 100 is mounted on member 28 at a distance below mounting block 66 and includes a film-clamping surface 102 facing the film 52 fed through unit 32. An air manifold 104 in the lower part of block 100 includes a plurality of air blast passages 106 opening through the lower portion of surface 102 and bottom surface 108. The manifold is connected to a source of compressed air through a suitable control valve, not illustrated.

Lower film clamp plate 110 located across from film 52 and opposite the top of block 100 is mounted on a pair of spaced rods 112 extending through the lower part of cut off housing 70. A back plate 114 is mounted on the ends of rods 112 on the opposite side of the plate 70. Spring 116 mounted in block 70 biases plate 110 toward film 52. A resilient film clamping bead 118, like bead 98, is provided in the clamping face of plate 110. Film cutting knife 120 is mounted in block 70 between clamp plates 76 and 110 and includes a serrated blade facing film 52. See FIG. 10.

The film pull down unit 34 includes film clamp 122 mounted on vertical bar 124 which is in turn mounted on rodless cylinder 126 for movement toward and away from unit 32. The film clamp 122 includes a clamp plate 128 having vertically extending spaced teeth 130 and a clamping jaw 132 pivotedly mountable in clamp 122 about pin 134 and including a number of vertically extending teeth 136 overlying teeth 130. The clamping faces of teeth 136 carry resilient film clamp beads 138 like beads 98 and 118. See FIG. 11. The clamping jaw 132 is connected to the piston rod of cylinder rod 140 mounted on bar 124 such that extension of the cylinder clamps fingers 136 against fingers 130 and retraction of the cylinder holds the fingers apart as shown in FIG. 7.

Cylinder 126 moves the bar 124 and clamp 122 between an elevated position where, as shown in FIG. 7, clamp jaw teeth 130 and 136 extend past clamp plate teeth 94 and into recesses 96 and a lower position as shown in FIG. 1 where the clamp overlies the film retention unit 36. Lowering of bar 124 end 142 against trips the trigger of microswitch 144. When fully lowered end 142 engages pad 146 on stop bracket 148. The bracket and microswitch are adjustably mounted on frame post 150 and can be moved up and down together to vary the stroke of cylinder 126 dependent upon the length of film segment required to wrap roll 20. Likewise, the spacing between the conveyor belts 14 and 26 and hold down strips 16 and 28 may be varied to accommodate different diameter rolls.

The film retention unit 36 includes vacuum box 152 located beneath the wrapping zone 24. A vertical perforated film retention plate 154 forms one side of box 152 and is located beneath the lower film clamp block 100 as shown in FIGS. 3 through 6. Plate 154 includes a vertical extension 156 projecting above box 152 immediately upstream from roller 46. Extension 156 need not be perforated. A small diameter freely rotatable film roller 158 is located above extension 156 and close to belt 26 on roller 46. The top of the roller 158 is at the same level as the tops of belts 14 and 26. The upstream side of roller 158 is above the upstream side of plate 154. Roller 158 guides film from the plate 154 into the wrapping zone 24.

A fan 160 mounted on the downstream side of the box 152 draws air out of the box to reduce the pressure within the box and assure that film drawn down over plate 154 by the film pull down unit is held in place on the plate until wrapping occurs. As shown in FIG. 1, clamp plate 128 overlies plate 154 and is moved along plate 154 by cylinder 126.

Electric light source and detector 161 is mounted next to plate 48 to one side of the wrapping zone 24. Light from the source crosses the path of roll movement as the roll rotates through the zone, hits mirror 162 located beneath the upper runs of belts 26 and is reflected back up from the mirror across the path to the detector. The beam is broken by movement of a roll through the wrapping zone.

The sequence of operation of banding machine 10 is determined by a conventional programmable controller including appropriate timing circuitry. The machine cycles completely for each roll rotated through the wrapping zone 24 and wrapped with a band of self adhering film 52. The film 52 may typically be obtained from commercially available self-cling linear low density polyethylene plastic film suppliers. The film has a thickness of 0.0008 to about 0.0012 inch and may be about two inches wide. The film is provided with tackifiers so that adjacent film surfaces adhere to each other. The tackifiers facilitate holding the film tightly around the roll.

The cycle of operation begins after a downstream roll 20 has been wrapped as it is moved through the zone 24 and a film segment 164 has been pulled down across the roll feed path with the lower end of the film held against perforated plate 154 by the reduced pressure in box 152. The lower end of the film extends between clamp plate 128 and the open teeth of clamping jaw 132. Cylinder 140 is retracted and cylinder 126 is in the lower position. Bar 124 is retracted and engages stop 146.

The cylinder 74 in the film clamp and cut off unit 32 is fully extended as shown in FIG. 9 so that the upper end of film segment 164 is clamped between block 100 and lower clamp plate 110 as shown in FIG. 9. Knife 120 has severed the film above block 100. The lower end of film 52 extending from roll 50 is clamped between plates 76 and 86. Extension of cylinder 74 compresses spring 92 and bottoms plate 86 against block 66.

Figure 3:
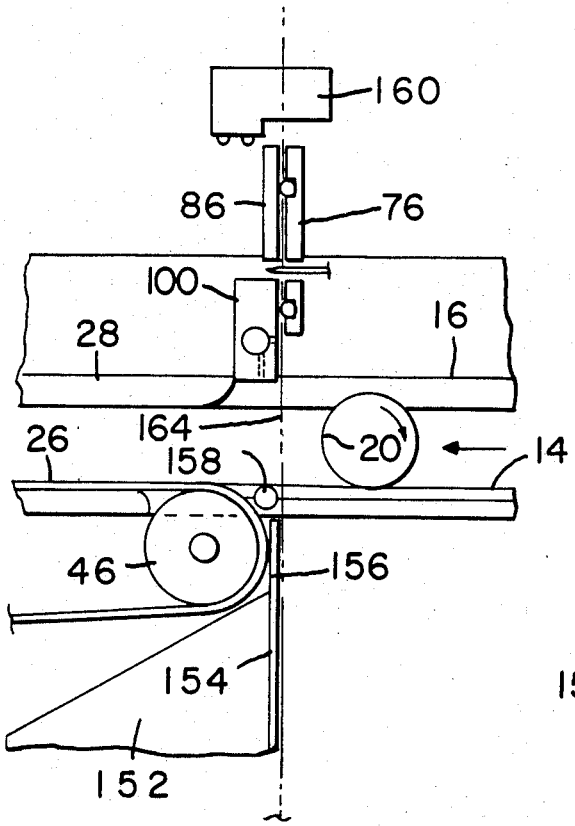
FIGS. 3 through 6 are enlarged views of a portion of FIG. 1 showing banding of a roll as it moves through a banding station.

Continuously downstream moving conveyor belts 14 rotate the next upstream roll 20 downstream toward the film segment 164 as illustrated in FIG. 3. The rotating and downstream translating roll engages the film segment and with continued downstream rotation and translation wraps the lower portion of the film segment held on plate 154 around the roll. During initial wrapping the upper end of the film segment is held clamped against movement. The vacuum retention of the film on plate 154 permits withdrawal of the film from the plate while maintaining tension in the film during wrapping to assure the film is tightly wound around the roll. The film extends from the plate past extension 156 and around roller 158 as shown in FIG. 5.

Figure 4:
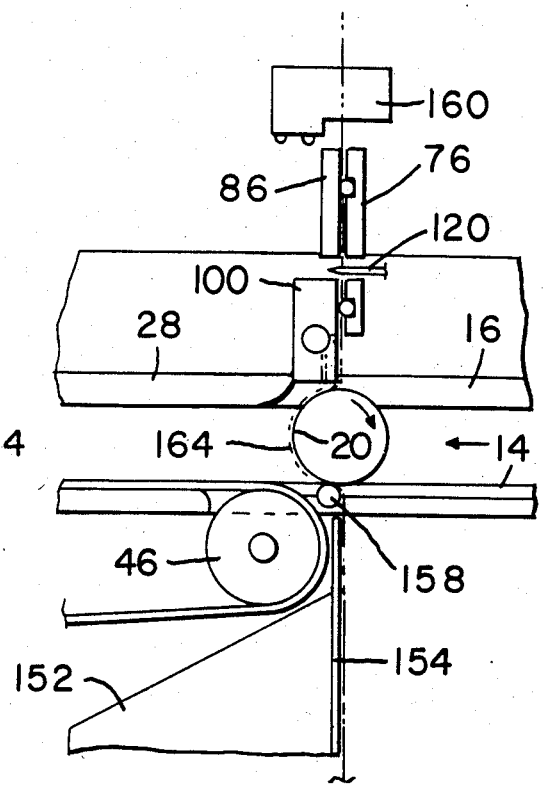

When the roll has proceeded into the wrapping zone 24 to the position of FIG. 4, the light beam sent from and received back by source and detector 161 is broken to initiate operation of the programmer. The programmer then operates a valve to retract cylinder 74 to release both the upper end of film segment 164 and the lower end of film 52. Clutch roller 56 and hold down 58 prevent retraction of the film. The film clamp and cut off unit 32 is in the position of FIG. 7. Spring 92 has moved plate 86 away from the clamp block 100 to provide room for subsequent pickup of the lower end of film 52. Retraction also moves plate 110 away from block 100 a sufficient distance to facilitate subsequent pick up of the film. Approximately 0.1 second after the upper end of the film 164 has been released the programmer opens a valve to flow compressed air to manifold 104 so that blasts of compressed air are flowed through passages 106. The compressed air flowing through the clamp surface 102 of block 100 blows the upper end of the film from the face. If desired, face 102 may be roughened by sand blasting or a plasma coating to reduce the possibility that the upper end of the film segment adheres to the surface after retraction of cylinder 74.

Figure 5:
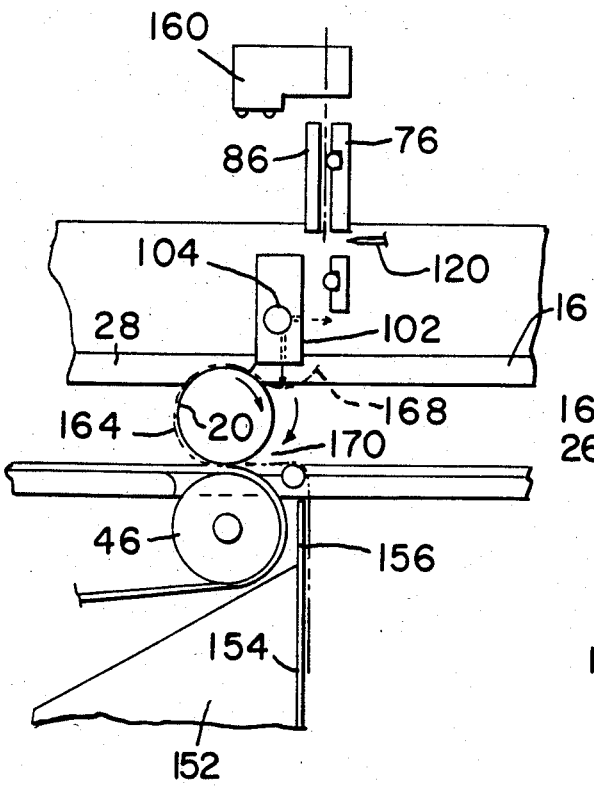
Figure 6:
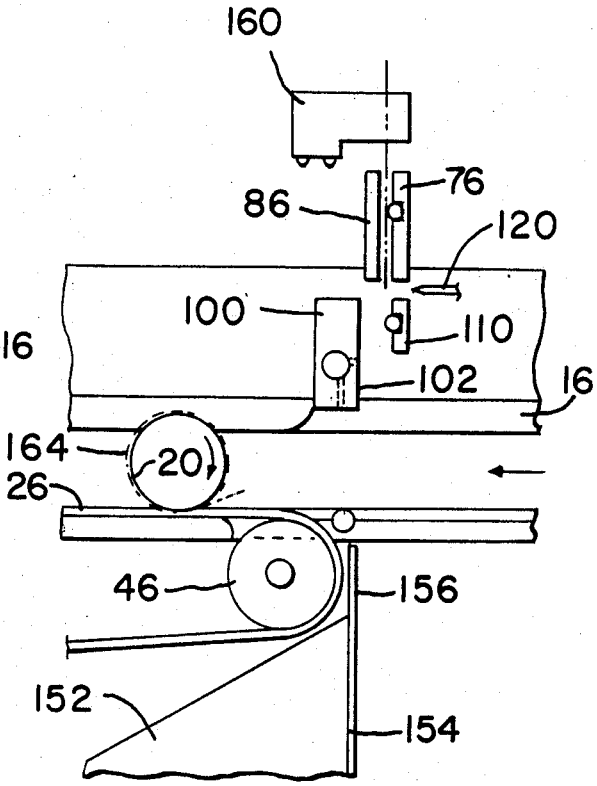

The roll 20 continues to rotate downstream following release of the upper end of the film segment as shown in FIG. 5. The air blast venting through the bottom of block 100 blows the freed upper segment end 168 down against the roll so that it engages the roll and is captured within the nip 170 between the roll and the remainder of the film segment being drawn up from plate 154 and wound onto the roll. Continued rotation of the roll brings the upper end 168 into contact with the film being wound onto the roll. During wrapping of the film on the roll the roll and film are confined between the upper run of belt 26 and hold down 28 as shown in FIGS. 5 and 6.

Figure 11A:
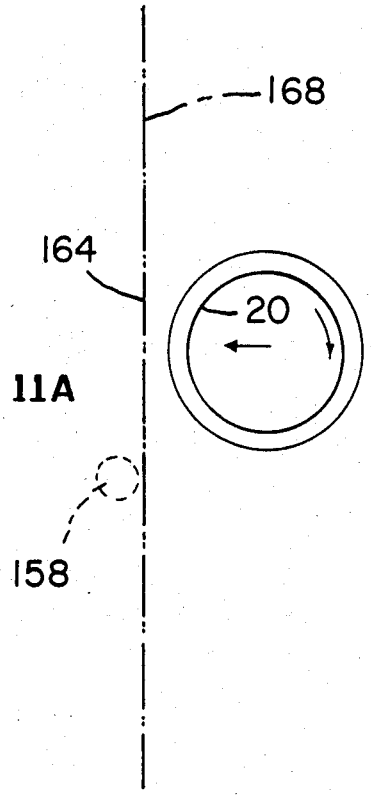
FIGS. 11A through 11D illustrate the steps of wrapping a film band around the roll as the roll moves through the wrapping zone.

FIGS. 11A through 11D further illustrate wrapping of the film segment around the roll. In FIG. 11A the roll approaches the vertical film segment with the upper end 168 clamped against movement and the lower end extending down past roller 158 and held in place on plate 154.

Figure 11B:
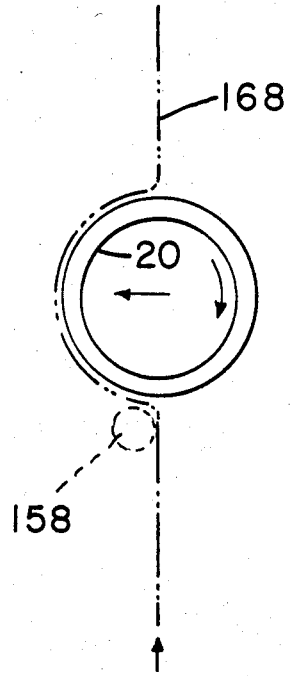

In FIG. 11B the roll has contacted the film and wrapping has commenced by drawing film up from the plate 154. The vacuum holding of the film on the plate provides tension for tight wrapping. The upper film end 168 remains clamped so that film is drawn onto the roll from the lower end of the segment only.

Figure 11C:
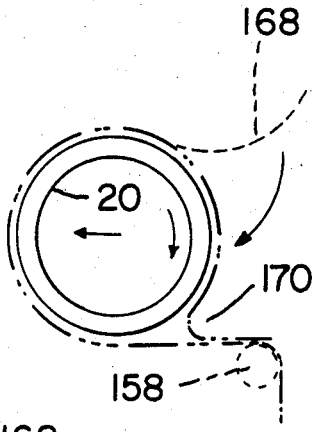
Figure 11D:
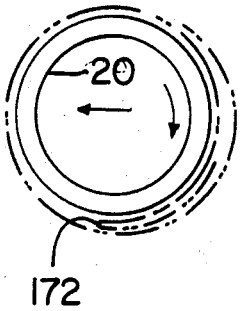

FIG. 11C illustrates a further step in wrapping in which the roll has moved downstream sufficiently to break the light beam so that the upper end 168 of the segment 164 is freed. As the free end passes under block 100 air jets blow the free end down as shown. In the case of a relatively small diameter roll the free end is blown down into the nip 170 and into contact with the film being pulled from plate 154 around roller 158 and onto the roll. The overlapping film segments adhere to each other so that with further downstream translation and rotation of the roll the upper end 168 is brought into an increasing area contact with the film pulled around roller 158 to form a tight wound wrap as shown in FIG. 11D with the end of the inner layer being bent back on itself at an end overlap 172 and captured between the first and second layers of the wrap. See FIG. 11D.

Figure 12:
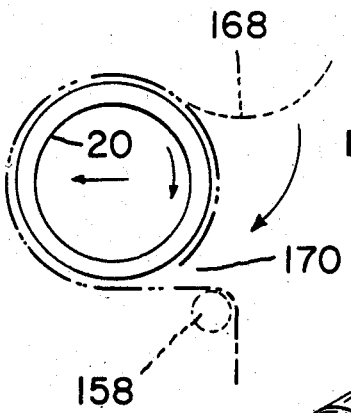
FIG. 12 is similar to FIG. 11C and illustrates wrapping of a relatively large diameter roll.

FIG. 12 is similar to FIG. 11C and illustrates wrapping of a somewhat larger diameter roll. With the larger diameter roll the segment end 168 is blown down into the nip and does not adhere to the film being drawn around roller 158. End 168 overlies the upstream side of the roll and is rotated into the nip. The subsequent rotation and downstream movement of the roll wraps the remainder of the film segment over the end 168 to form a spiral wrap without an end overlap.

The controller turns off the air blast after the upper end of the film segment has been blown into the nip. After the roll has moved downstream past plate 154, about 0.1 of a second after turning on the air blast, the controller actuates cylinder 126 to raise the film feed unit 34 from the retracted position of FIG. 1 to the elevated position where the teeth on plate 128 and open jaw 132 extend into recesses 96 in separated plates 76 and 86 to either side of the lower end of the film 52 as shown in FIG. 7.

The controller then extends cylinder 140 so that teeth 136 clamp the lower end of the film against teeth 130. Following clamping of the film, the controller actuates cylinder 126 to retract unit 34 and to draw a new length of film 52 down across the roll feed path and onto plate 154. During retraction the lower end 142 of bar 124 engages the trigger of switch 144 to deactuate cylinder 126. Unit 34 coasts to a stop with end 142 engaging pad 146. Cylinder 74 is extended to clamp the new length of film 52 drawn between the clamp plates. The film is clamped in place as shown in FIG. 8 prior to full extension of the cylinder. Spring 92 is compressed and plate 86 is flush on block 66 so that the film extends essentially straight between the two clamps. Final extension of cylinder 74 drives knife 120 through the film between the clamps to cut the film and form a new film segment 164 for wrapping the next upstream roll as described.

After a short timing interval of approximately 0.1 second the controller retracts cylinder 140 to open teeth 130 and 136 so that the vacuum in box 152 holds the lower end of the film in place to complete the cycle of operation. A new film segment extends across the roll path and is in position to be wrapped around the next downstream moving roll.

During retraction of cylinder 74 to open the film clamps the cut off housing 70 is drawn away from the film while springs 84 and 116 continue to hold plates 76 and 110 against the film. The cut off housing moves the plates 76 and 110 upon engagement, respectively, with back plates 80 and 114. If desired, resilient bumpers may be mounted on the back plates to cushion contact between the plates and the cut off housing during retraction of cylinder 74.

Figure 13:
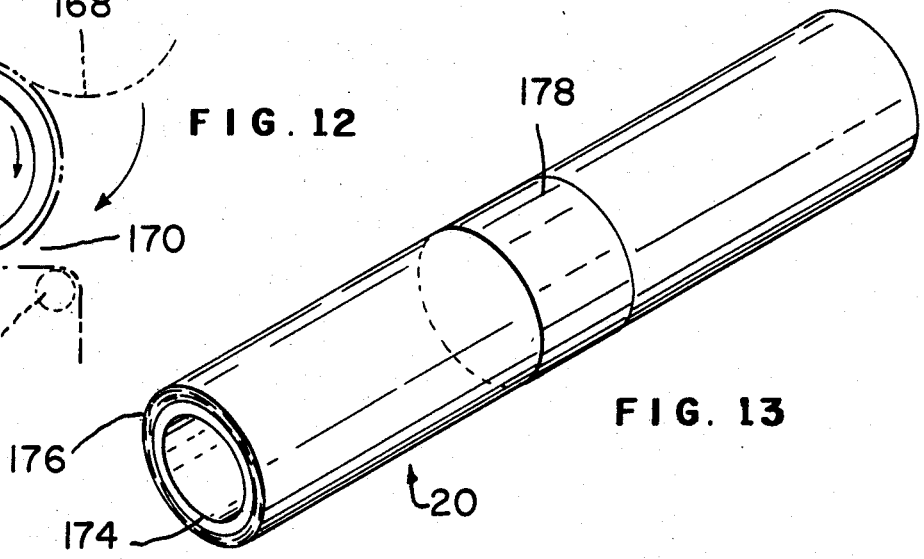
FIG. 13 is a perspective view of a roll wrapped by a single band of the type described.

FIG. 13 illustrates a roll wrapped with a band of self-adherent transparent self cling stretch film by banding machine 10. Roll 20 may or may not include a cylindrical cardboard core 174. A predetermined length of paper 176 is wound with or without a core and is held in the shape of a tube by a wound cylindrical band 178 formed from a film segment 164 as described. The band is transparent permitting visual inspection of the paper beneath the band. The film layers of the wrapping tightly adhere to each other to hold the paper from unwrapping. If required, machine 10 may include a number of roll band assemblies 22 spaced along the length of rolls moved through the machine to provide a corresponding number of bands per roll. Longer rolls may require plural wrappings to hold the paper in place.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What we claim as our invention is:

1. A roll banding machine including (a) Conveying means for moving a roll along a path and through a wrapping zone; and (b) A roll wrapping assembly for wrapping a segment of self-adherent film around a roll as the roll is moved through the wrapping zone, the assembly including:

(i) A film cut off on one side of the wrapping zone operable to sever a length of film from a supply of film to form a film segment, (ii) A first film clamp located between the film cut off and the wrapping zone operable to clamp one end of a film segment extending into the wrapping zone, (iii) Film retention means located on the other side of the wrapping zone across from the first film clamp for holding the other end of a film segment in place so that the segment extends across the wrapping zone between the film clamp and the retention unit in the path of movement of the roll through the zone and permitting withdrawal of the film as the segment is wound onto the roll, (iv) Film feed means extendable across the wrapping zone between the film cut off and the film retention means for engaging the end of a length of film at the film cut off and pulling the film across the wrapping zone and into engagement with the film retention means, (v) Film feed release means for opening the film clamp and releasing the one end of the film segment after initial wrapping of the other end of the segment around a roll moving through the wrapping zone, (vi) Rotating means for rotating a roll moving downstream through the wrapping zone, and (vii) Holding means for holding the film against the roll during wrapping, whereby the roll rotates through the wrapping zone, engages the film segment extending across the zone, wraps the film segment around the roll as film is withdrawn from the retention unit and, upon opening of the film clamp, wraps the withdrawn film around the freed one end of the film segment to form a self adherent film band wound around the roll.

2. A roll banding machine as in claim 1 wherein the film retention means includes a plate adjacent the path of movement of the film feed means and means for holding the other end of the film segment flush against the plate while permitting withdrawal of the film from the plate during wrapping.

3. A roll banding machine as in claim 2 wherein the plate faces upstream.

4. A roll banding machine as in claim 3 wherein the plate is perforated and the means for holding includes a reduced pressure vacuum source communicating with the side of the plate away from the film feed means so that the film is pressure-held against the plate.

5. A roll banding machine as in claim 1 wherein the holding means comprises a fixed hold down strip extending along one side of the wrapping zone and a downstream moving surface on the other side of the wrapping zone whereby the film segment is captured between the roll and both the strip and the conveyor belt during wrapping.

6. A roll banding machine as in claim 5 wherein the surface is one run of a moving continuous conveyor belt.

7. A roll banding machine as in claim 1 including a second film clamp located on the side of the film cut off away from the first film clamp and including a pair of clamp plates extending across the film, spaced teeth on each plate extending toward the wrapping zone and drive means for moving the clamp plates toward each other to clamp the film therebetween and apart from each other to release the film, and the film feed means includes a pair of opposed clamp members extendable into the space between adjacent teeth at the clamp plates to surround and clamp the film when the film feed means is extended across the wrapping zone.

8. A roll banding machine as in claim 1 wherein said first film clamp includes a clamp block, a clamp plate, drive means for moving the clamp plate into engagement with and away from the clamp block to clamp the one end of a film segment, and disengagement means for separating the one end of the film segment from the clamp block when the clamp plate is away from th clamp block.

9. A roll banding machine as in claim 8 wherein the disengagement means includes air blast means.

10. A roll banding machine as in claim 9 wherein said air blast means includes a manifold in the clamp block and air blast passages extending from the manifold and through the surface of the clamp block facing the clamp plate.

11. A roll banding machine as in claim 10 including additional air blast passages in the clamp block extending from the manifold to mouths facing the wrapping zone for blowing the released one end of the film segment against a roll moving through the wrapping zone.

12. A roll banding machine as in claim 11 including film separation means on the surface of the clamp block facing the clamp plate for reducing adherence of the one end of the film segment on the clamp block.

13. The method of banding a roll by wrapping a segment of soft adherent film around the roll comprising the steps of:

(a) Positioning a segment of self-adherent film across a wrapping zone with one end of the segment on one side of the zone and the other segment on the other side of the zone;

(b) Rotating a roll through the wrapping zone and into contact with the film with the downstream side of the roll rotating away from the other side of the zone;

(c) Withdrawing film from the other side of the zone and wrapping the withdrawn film around the roll while holding the one end of the film segment against withdrawal into the zone;

(d) Releasing the held one end of the film segment and moving such end into contact with the upstream side of the roll;

(e) Continuing to withdraw film from the other side of the wrapping zone and wrapping such film over the one end of the film segment on the roll to form a continuous circumferential band surrounding the roll with an overlapping and self adhering portion.

14. The method of claim 13 including the step of maintaining tension in the other end of the film segment during wrapping.

15. The method of claim 13 including the step of moving said one end of the film segment into contact with the other end of the film segment during wrapping.

16. The method of claim 13 including the step of vacuumholding said other end of the film segment in place on the other side of the wrapping zone prior to and during wrapping.

* * * * *